US007854022B2

(12) United States Patent
Warren et al.

(10) Patent No.: US 7,854,022 B2
(45) Date of Patent: Dec. 21, 2010

(54) GARMENTS HAVING SEAMLESS EDGE BANDS AND PROCESSES FOR MAKING SAME

(75) Inventors: Roger D. Warren, Claremont, NC (US); Rick Kelley, Germanton, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 527 days.

(21) Appl. No.: 11/032,285

(22) Filed: Jan. 10, 2005

(65) Prior Publication Data

US 2006/0150302 A1 Jul. 13, 2006

(51) Int. Cl.
*A41B 9/00* (2006.01)
*A41C 1/00* (2006.01)

(52) U.S. Cl. ..... 2/401; 450/151

(58) Field of Classification Search ..... 2/400–408, 2/236; 450/156, 109, 112, 39, 40, 151, 66, 450/70

See application file for complete search history.

(56) References Cited

U.S. PATENT DOCUMENTS

| | | | | |
|---|---|---|---|---|
| 2,285,967 | A | 6/1942 | Hardy | |
| 2,304,989 | A | 12/1942 | Snowdon | |
| 2,551,811 | A | 5/1951 | Mueller | |
| 2,617,102 | A | 11/1952 | MacHenry | |
| 2,739,919 | A | 3/1956 | Artzt | |
| 2,867,889 | A | 1/1959 | Thompson, Jr. | |
| 2,915,067 | A | 12/1959 | Bracht | |
| 2,962,025 | A | 11/1960 | Bertrand | |
| 3,021,844 | A | 2/1962 | Flagg et al. | |
| 3,070,870 | A | 1/1963 | Alexander et al. | |
| 3,164,655 | A | 1/1965 | Howard et al. | |
| 3,168,749 | A * | 2/1965 | Cala | 2/269 |
| 3,225,768 | A | 12/1965 | Galitzki et al. | |
| 3,228,401 | A | 1/1966 | Byrne | |
| 3,254,402 | A | 6/1966 | Balamuth et al. | |
| 3,312,224 | A | 4/1967 | Coates et al. | |
| 3,317,645 | A | 5/1967 | Nirenberg | |
| 3,320,346 | A | 5/1967 | Galitzki et al. | |
| 3,327,707 | A | 6/1967 | Storti | |
| 3,383,263 | A | 5/1968 | Storti | |
| 3,417,755 | A | 12/1968 | Howard et al | |
| 3,465,755 | A | 9/1969 | Grishman | |

(Continued)

FOREIGN PATENT DOCUMENTS

| | | |
|---|---|---|
| EP | 1 166 659 | 1/2002 |

(Continued)

*Primary Examiner*—Alissa L Hoey
(74) *Attorney, Agent, or Firm*—Womble Carlyle Sandridge & Rice, PLLC

(57) ABSTRACT

A garment having a fabric layer and an edge band is provided. The edge band and the fabric layer each include a sonically weldable material. The garment has a sonic edge weld securing the edge band to the fabric layer along a cut edge of the garment and an adhesive securing the edge band to the fabric layer. During manufacture, the edge band is placed on the fabric layer, sonic energy is applied so that the fabric layer and the edge band are simultaneously trimmed along a cut edge and welded to one another along the cut edge, and an adhesive between the fabric layer and the edge band is activated to adhere the edge band to the fabric layer.

8 Claims, 3 Drawing Sheets

U.S. PATENT DOCUMENTS

| | | | | | |
|---|---|---|---|---|---|
| 3,497,415 | A | | 2/1970 | Adachi | |
| 3,502,083 | A | | 3/1970 | Howard et al. | |
| 3,560,292 | A | | 2/1971 | Butter | |
| 3,568,681 | A | * | 3/1971 | Comollo | 450/54 |
| 3,574,520 | A | | 4/1971 | Aldrich | |
| 3,597,800 | A | | 8/1971 | Silverman | |
| 3,663,962 | A | | 5/1972 | Burger | |
| 3,750,673 | A | | 8/1973 | Penrock | |
| 3,755,058 | A | | 8/1973 | Winkler | |
| 3,789,098 | A | | 1/1974 | Cole et al. | |
| 3,799,174 | A | | 3/1974 | Howard | |
| 3,828,367 | A | | 8/1974 | Bourgeois | |
| 3,868,729 | A | | 3/1975 | Lynam | |
| 3,874,963 | A | * | 4/1975 | Barger | 156/73.2 |
| 3,881,041 | A | * | 4/1975 | Glienke | 428/41.7 |
| 3,882,549 | A | * | 5/1975 | Gaburo | 2/244 |
| 3,891,377 | A | | 6/1975 | Howard | |
| 3,939,023 | A | | 2/1976 | Magidson et al. | |
| 4,031,568 | A | | 6/1977 | Huff | |
| 4,079,466 | A | * | 3/1978 | Rosenstein | 2/87 |
| 4,090,900 | A | | 5/1978 | Jacaruso et al. | |
| 4,135,025 | A | | 1/1979 | Backes | |
| 4,148,322 | A | | 4/1979 | Jacaruso et al. | |
| 4,172,002 | A | | 10/1979 | Gluckin | |
| 4,190,010 | A | * | 2/1980 | Bibby | 112/419 |
| 4,202,853 | A | | 5/1980 | DiTullio | |
| 4,205,679 | A | * | 6/1980 | Repke et al. | 604/366 |
| 4,259,220 | A | | 3/1981 | Bunnelle et al. | |
| 4,276,109 | A | | 6/1981 | Siewert et al. | |
| 4,324,245 | A | * | 4/1982 | Mesek et al. | 604/370 |
| 4,337,771 | A | | 7/1982 | Pieniak et al. | |
| 4,353,762 | A | | 10/1982 | Bouda | |
| 4,355,425 | A | * | 10/1982 | Jones et al. | 2/402 |
| 4,372,321 | A | | 2/1983 | Robinson | |
| 4,375,445 | A | | 3/1983 | Cole et al. | |
| 4,386,990 | A | | 6/1983 | Gluckin | |
| 4,398,981 | A | | 8/1983 | Ellis | |
| 4,400,227 | A | | 8/1983 | Riemersma | |
| 4,418,123 | A | * | 11/1983 | Bunnelle et al. | 428/517 |
| 4,419,997 | A | | 12/1983 | Cole et al. | |
| 4,479,836 | A | | 10/1984 | Dickover et al. | |
| 4,481,951 | A | | 11/1984 | Cole et al. | |
| 4,486,192 | A | | 12/1984 | Sigl | |
| 4,492,608 | A | | 1/1985 | Hirsch et al. | |
| 4,496,407 | A | | 1/1985 | Lowery et al. | |
| 4,519,857 | A | | 5/1985 | Clay | |
| 4,525,229 | A | | 6/1985 | Suzuki et al. | |
| 4,532,819 | A | | 8/1985 | Ross | |
| 4,542,771 | A | | 9/1985 | Payet et al. | |
| 4,543,099 | A | | 9/1985 | Bunnelle et al. | |
| 4,557,267 | A | | 12/1985 | Cole | |
| 4,560,427 | A | | 12/1985 | Flood | |
| 4,572,195 | A | | 2/1986 | Hyams | |
| 4,610,681 | A | * | 9/1986 | Strohbeen et al. | 604/396 |
| 4,618,384 | A | | 10/1986 | Sabee | |
| 4,624,115 | A | * | 11/1986 | Safrit et al. | 66/172 R |
| 4,627,427 | A | | 12/1986 | Arco | |
| 4,639,949 | A | * | 2/1987 | Ales et al. | 2/400 |
| 4,641,381 | A | * | 2/1987 | Heran et al. | 2/400 |
| 4,671,264 | A | | 6/1987 | Frangi | |
| 4,693,771 | A | | 9/1987 | Payet et al. | |
| 4,701,964 | A | | 10/1987 | Bell et al. | |
| 4,703,706 | A | | 11/1987 | Plante | |
| 4,710,189 | A | * | 12/1987 | Lash | 604/385.27 |
| 4,719,261 | A | | 1/1988 | Bunnelle et al. | |
| 4,726,807 | A | * | 2/1988 | Young et al. | 604/385.26 |
| 4,755,242 | A | | 7/1988 | Miller et al. | |
| 4,771,483 | A | | 9/1988 | Hooreman et al. | |
| 4,776,916 | A | | 10/1988 | Prunesti et al. | |
| 4,875,241 | A | | 10/1989 | Browder, Jr. et al. | |
| 4,895,569 | A | * | 1/1990 | Wilson et al. | 604/386 |
| 4,920,769 | A | * | 5/1990 | Rickerl | 66/176 |
| 4,938,821 | A | | 7/1990 | Soderlund et al. | |
| 4,968,313 | A | | 11/1990 | Sabee | |
| 4,976,706 | A | | 12/1990 | Aki et al. | |
| 5,042,176 | A | | 8/1991 | Rudy | |
| 5,140,757 | A | | 8/1992 | Terada | |
| 5,154,659 | A | | 10/1992 | Gluckin | 450/39 |
| 5,163,932 | A | * | 11/1992 | Nomura et al. | 604/385.29 |
| 5,193,225 | A | | 3/1993 | Karami et al. | |
| 5,204,997 | A | * | 4/1993 | Suzuki et al. | 2/400 |
| 5,229,181 | A | | 7/1993 | Daiber et al. | |
| 5,234,523 | A | | 8/1993 | Battreall | |
| D342,997 | S | * | 1/1994 | Buck et al. | D24/126 |
| 5,339,467 | A | * | 8/1994 | Brinkley | 2/209 |
| 5,340,424 | A | * | 8/1994 | Matsushita | 156/164 |
| 5,352,518 | A | | 10/1994 | Muramoto et al. | |
| 5,406,646 | A | | 4/1995 | Balit et al. | |
| 5,447,462 | A | * | 9/1995 | Smith et al. | 450/122 |
| 5,498,468 | A | | 3/1996 | Blaney | |
| 5,531,850 | A | | 7/1996 | Herrmann | |
| 5,545,158 | A | * | 8/1996 | Jessup | 604/385.3 |
| 5,569,234 | A | * | 10/1996 | Buell et al. | 604/396 |
| 5,628,741 | A | * | 5/1997 | Buell et al. | 604/385.27 |
| 5,669,996 | A | * | 9/1997 | Jessup | 156/85 |
| 5,680,653 | A | * | 10/1997 | Mathis et al. | 2/123 |
| 5,682,618 | A | * | 11/1997 | Johnson et al. | 2/275 |
| 5,690,626 | A | * | 11/1997 | Suzuki et al. | 604/385.25 |
| 5,782,191 | A | * | 7/1998 | Wong | 112/441 |
| 5,800,418 | A | | 9/1998 | Ahr | |
| 5,807,368 | A | | 9/1998 | Helmer | |
| 5,820,443 | A | | 10/1998 | Burr | 450/40 |
| 5,946,944 | A | * | 9/1999 | Osborne | 66/176 |
| 5,967,876 | A | | 10/1999 | Kollmanthaler et al. | |
| 5,984,762 | A | | 11/1999 | Tedeschi et al. | |
| 6,000,994 | A | | 12/1999 | Salotto | 450/92 |
| 6,004,306 | A | * | 12/1999 | Robles et al. | 604/385.21 |
| 6,041,446 | A | * | 3/2000 | Braunstein et al. | 2/400 |
| 6,057,024 | A | | 5/2000 | Mleziva et al. | |
| 6,070,542 | A | * | 6/2000 | Wong | 112/475.09 |
| 6,079,343 | A | * | 6/2000 | Wong | 112/475.09 |
| 6,083,212 | A | * | 7/2000 | Kumasaka | 604/385.29 |
| 6,096,164 | A | | 8/2000 | Benson et al. | |
| 6,125,664 | A | * | 10/2000 | Browder, Jr. | 66/176 |
| 6,168,585 | B1 | * | 1/2001 | Cesco-Cancian | 604/385.26 |
| 6,192,717 | B1 | * | 2/2001 | Rabinowicz | 66/177 |
| 6,193,701 | B1 | * | 2/2001 | Van Gompel et al. | 604/385.01 |
| 6,210,388 | B1 | * | 4/2001 | Widlund et al. | 604/390 |
| 6,240,561 | B1 | * | 6/2001 | Mc Ginnis | 2/69.5 |
| 6,240,563 | B1 | * | 6/2001 | Niedermeyer | 2/114 |
| 6,240,569 | B1 | | 6/2001 | Van Gompel et al. | |
| 6,286,144 | B1 | * | 9/2001 | Henderson et al. | 2/69 |
| 6,316,687 | B1 | * | 11/2001 | Davis et al. | 604/372 |
| 6,340,782 | B1 | | 1/2002 | Kling et al. | |
| 6,503,235 | B2 | * | 1/2003 | Suzuki et al. | 604/385.11 |
| 6,516,473 | B2 | * | 2/2003 | Saito | 2/400 |
| 6,517,651 | B2 | * | 2/2003 | Azulay | 156/73.1 |
| 6,578,504 | B2 | * | 6/2003 | Nelson et al. | 112/475.06 |
| 6,613,033 | B1 | * | 9/2003 | Popp et al. | 604/385.25 |
| 6,622,312 | B2 | * | 9/2003 | Rabinowicz | 2/401 |
| 6,645,040 | B2 | | 11/2003 | Rabinowicz et al. | |
| 6,649,251 | B1 | * | 11/2003 | Druecke et al. | 428/198 |
| 6,764,478 | B2 | * | 7/2004 | Ashton et al. | 604/385.25 |
| 6,793,650 | B2 | * | 9/2004 | Weber | 604/396 |
| 6,837,771 | B2 | * | 1/2005 | Falla | 450/39 |
| 7,051,557 | B2 | * | 5/2006 | Mitchell et al. | 66/179 |
| 7,131,888 | B2 | * | 11/2006 | Hsu | 450/39 |
| 7,191,720 | B2 | * | 3/2007 | Thomas | 112/475.09 |
| 7,201,744 | B2 | * | 4/2007 | Van Gompel et al. | 604/391 |
| 7,214,120 | B2 | * | 5/2007 | Kaye et al. | 450/39 |
| 7,228,809 | B2 | * | 6/2007 | Angelino et al. | 112/475.08 |
| 7,258,762 | B2 | * | 8/2007 | Fowler | 156/308.2 |
| 7,374,627 | B2 | * | 5/2008 | McCabe | 156/73.1 |
| 7,407,427 | B2 | * | 8/2008 | Liu | 450/39 |

2001/0001300 A1* 5/2001 Tolbert et al. ..... 442/60
2001/0016722 A1* 8/2001 Matsushita et al. ..... 604/396
2002/0000684 A1 1/2002 Nakanishi ..... 264/257
2002/0052590 A1* 5/2002 Zehner et al. ..... 604/385.01
2002/0056510 A1 5/2002 Erdos et al.
2002/0111119 A1* 8/2002 Johnson et al. ..... 450/86
2002/0151239 A1 10/2002 Aerts
2002/0152775 A1* 10/2002 Browder, Jr. ..... 66/170
2003/0019251 A1* 1/2003 Browder et al. ..... 66/171
2003/0066593 A1* 4/2003 Kopelowicz ..... 156/229
2003/0131399 A1* 7/2003 Forsyth et al. ..... 2/401
2003/0135184 A1* 7/2003 Van Gompel et al. .. 604/385.01
2003/0192351 A1* 10/2003 Meckley et al. ..... 66/170
2004/0014394 A1* 1/2004 Mitchell et al. ..... 450/65
2004/0151864 A1* 8/2004 Thomas ..... 428/58
2004/0238103 A1* 12/2004 Cano ..... 156/155
2005/0000622 A1* 1/2005 Cano ..... 156/93
2005/0097658 A1* 5/2005 Lyons et al. ..... 2/267
2005/0159078 A1* 7/2005 Querquant ..... 450/66
2007/0088312 A1* 4/2007 Langdon et al. ..... 604/396
2008/0196136 A1* 8/2008 Fellouhe et al. ..... 2/69
2008/0282451 A1* 11/2008 Simpson ..... 2/406
2009/0088713 A1* 4/2009 Norrby ..... 604/365

FOREIGN PATENT DOCUMENTS

GB 2051653 7/1979

* cited by examiner

GARMENTS HAVING SEAMLESS EDGE BANDS AND PROCESSES FOR MAKING SAME

BACKGROUND OF THE INVENTION

1. Field of the Invention

The present invention relates to garments. More particularly, the present invention relates to garments having edge bands seamlessly secured thereto and processes for making such garments.

2. Description of Related Art

Many types of garments require bands secured to the edge of the garment. In some instances, the band provides elasticity to the edge of the garment to maintain the garment in a desired location when worn. For example, intimate apparel garments such as, but not limited to, briefs and panties include an elastic waistband and often include elastic leg bands. Garments such as brassieres include an elastic chest band, while garments such as socks and hosiery include elastic leg bands. In other instances, the band can provide a decorative or aesthetic effect to the garment.

Sewn seams have traditionally been used to secure the band to the garment edge. In applications where the band rests against the skin of the wearer, the sewn seams can be a source of physical and/or aesthetic discomfort. For example, the seams can cause chaffing and discomfort to the skin. In addition, the sewn seams can be bulky so as to be seen through the outer clothing of the wearer.

Adhesives have been previously used to secure bands to garments. While adhered bands can resolve some of the discomforts associated with sewn seams, the adhered bands can lead to other deleterious effects. For example, the normal washing and drying cycles that typical garments are exposed to require the use of aggressive adhesives that can diminish the elasticity of the band and/or negatively effect the hand feel of the garment. Also, the manufacture of garments having adhered bands has proven to require additional process steps that lead to increased garment costs and decreased productivity.

The use of sonic energy, both sub-sonic and ultrasonic, to bond or weld (hereinafter "weld") materials having thermoplastic components has also been used to secure elastic bands to garments, such as in the disposable diaper industry. The process involves the use of high frequency mechanical vibrations that cause friction and melting at adjoining surfaces of the thermoplastic components, fusing them together in a strong molecular bond. Typically, the process includes pressing the materials to be joined between a vibrating horn and an anvil. The horn channels mechanical vibrations into the materials to fuse the materials at the location of the horn. Sonic welded elastic bands can result in increased productivity but have not proven durable enough for many non-disposable garment applications.

Accordingly, there is a continuing need for garments having bands seamlessly secured thereto and processes for making such garments that resolve one or more and other deleterious effects and drawbacks of prior garments and processes.

BRIEF SUMMARY OF THE INVENTION

It is an object of the present invention to provide garments having bands seamlessly secured thereto.

It is another object to provide processes for seamlessly securing bands to garments.

These and other objects and advantages of the present invention are provided by a garment having a fabric layer and an edge band. The edge band and the fabric layer each include a sonically weldable material. The garment also has a sonic edge weld securing the edge band to the fabric layer along a cut edge of the garment and an adhesive securing the edge band to the fabric layer.

Further objects and advantages are provided by a process for making a garment. The process includes placing an edge band on a fabric layer, the fabric layer and edge band each including a sonically weldable material; applying sonic energy to the fabric layer and the edge band so that the fabric layer and the edge band are simultaneously trimmed along a cut edge and welded to one another along the cut edge; and activating an adhesive between the fabric layer and the edge band to adhere the edge band to the fabric layer.

The above-described and other features and advantages of the present invention will be appreciated and understood by those skilled in the art from the following detailed description, drawings, and appended claims.

DETAILED DESCRIPTION OF THE INVENTION

Figure 1:
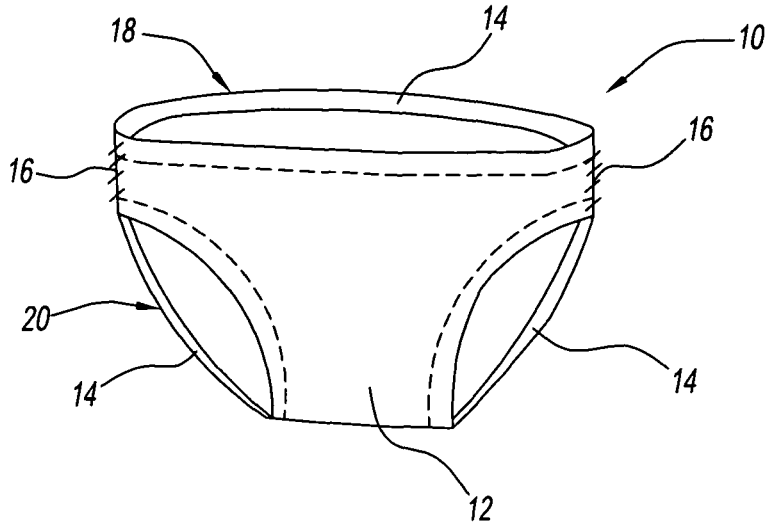
FIG. 1 is a perspective view of an exemplary embodiment of a garment according to the present invention.
Figure 2:
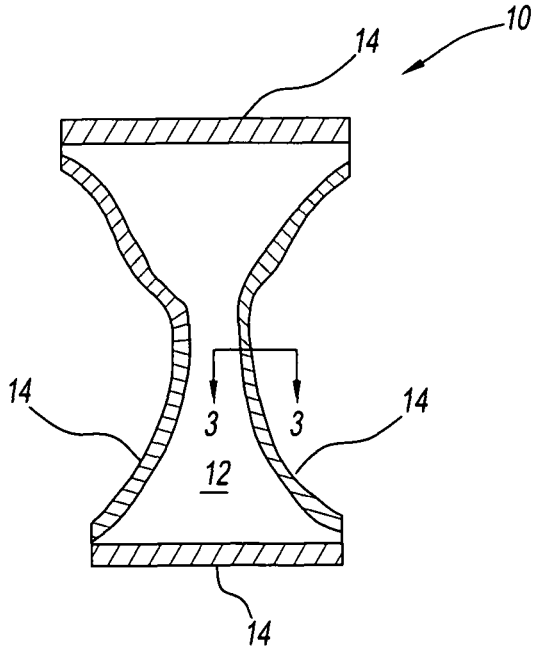
FIG. 2 is a view of the garment of FIG. 1 prior to the addition of side seams.
Figure 3:
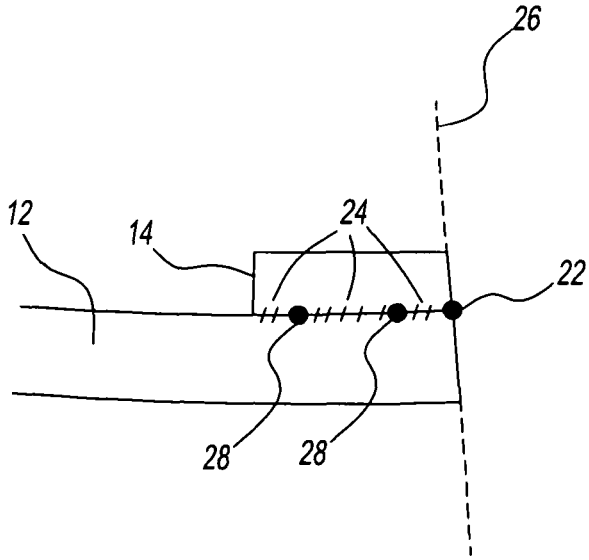
FIG. 3 is a sectional view taken along lines 3-3 of FIG. 2.

Referring to the drawings and in particular to FIGS. 1 and 2, an exemplary embodiment of a garment according to the present invention generally referred to by reference numeral 10 is shown. Garment 10 includes a fabric layer 12 having an edge band 14 secured to one or more regions of the fabric layer. In the illustrated embodiment, garment 10 includes side seams 16 for securing portions of fabric layer 12 to one another.

Garment 10 is illustrated by way of example as a panty having an elastic edge band 14 secured to a waist region 18 and leg region 20. Of course, it is contemplated by the present invention for garment 10 to be any other apparel or clothing item such as, but not limited to, a brassiere, a shirt, a pair of pants, a coat, a sock, a pair of pantyhose, a bathing suit, a camisole, a boxer short, a men's brief, and any other clothing item having an edge band secured to any desired region.

In addition, garment 10 is illustrated by way of example having a single fabric layer 12. Of course, it is contemplated by the present invention for garment to include more than one fabric layer 12.

Edge band 14 is seamlessly secured to fabric layer 12 by an edge weld 22 and an adhesive 24. As described in detail below, the energy input into garment 10 to define edge weld 22 can also simultaneously trim fabric layer 12 and edge band 14 to define a cut edge 26 of garment 10. Advantageously, edge weld 22 also seals cut edge 26 so that the free outer edge of the fabric layer 12 and a free edge of the edge band 14 terminate at the same point and do not fray during use of the garment 10. Further, the simultaneous cutting of the fabric layer 12 and edge band 14 at cut edge 26 ensures that the fabric layer and band are co-planar at the cut edge. Thus, fabric layer 12 and edge band 14 are sonically welded to one another along cut edge 26 and are adhered to one another in the remaining portions where the band overlaps the fabric layer. In one embodiment, the adhesive 24 is applied along more than half of the inner surface of the edge band 14.

In some embodiments, edge band 14 can further be seamlessly secured to fabric layer 12 by one or more tack welds 28. As described in detail below, edge weld 22, and tack welds 28 if present, hold fabric layer 12 and edge band 14 in place with respect to one another during the manufacturing process prior to activation of adhesive 24.

Fabric layer 12 and/or edge band 14 can be any non-woven fabric, woven fabric, or knitted fabric having between about ten percent and about one hundred percent of a sonically weldable material and all subranges therebetween. Sonically weldable materials include polypropylene, lycra spandex, tricot, polyester, nylon, acrylic, vinyl, PVC, thermoplastic urethane, or any combinations and blends thereof. Advantageously, fabric layer 12 and/or edge band 14 have up to about ninety percent natural fibers.

In a preferred embodiment, fabric layer 12 and edge band 14 can be a blend of about sixty percent sonically weldable material and about forty-percent natural fibers. In another embodiment, fabric layer 12 is a blend of about twelve percent sonically weldable material and about eighty-eight percent natural fibers, while edge band 14 is a blend of one hundred percent sonically weldable material.

It is believed that fabric layer 12 and/or edge band 14 having a fine denier may include at least about 70 percent natural fibers.

Adhesive 24 can be any heat activated adhesive material. In some embodiments, adhesive 24 can impart a desired elasticity to garment 10. In other embodiments, edge band 14 alone or in combination with adhesive 24 can impart a desired elasticity to garment 10. Thus, garment 10 can be provided with elasticity at its edges by adhesive 24, edge band 14, or any combination thereof.

Adhesive 24 is preferably a heat activated adhesive net or film. For example, adhesive 24 can be a heat activated adhesive net that provides elasticity to garment 10 such as the adhesive nets commercially available under the DELNET tradename from Delstar Technologies of Austin, Tex. In another example, adhesive 24 can be a heat activated elastic film such as the adhesive films commercially available under the tradename SEWFREE from Bemis Associates Incorporated of Shirley, Mass.

Figure 4:
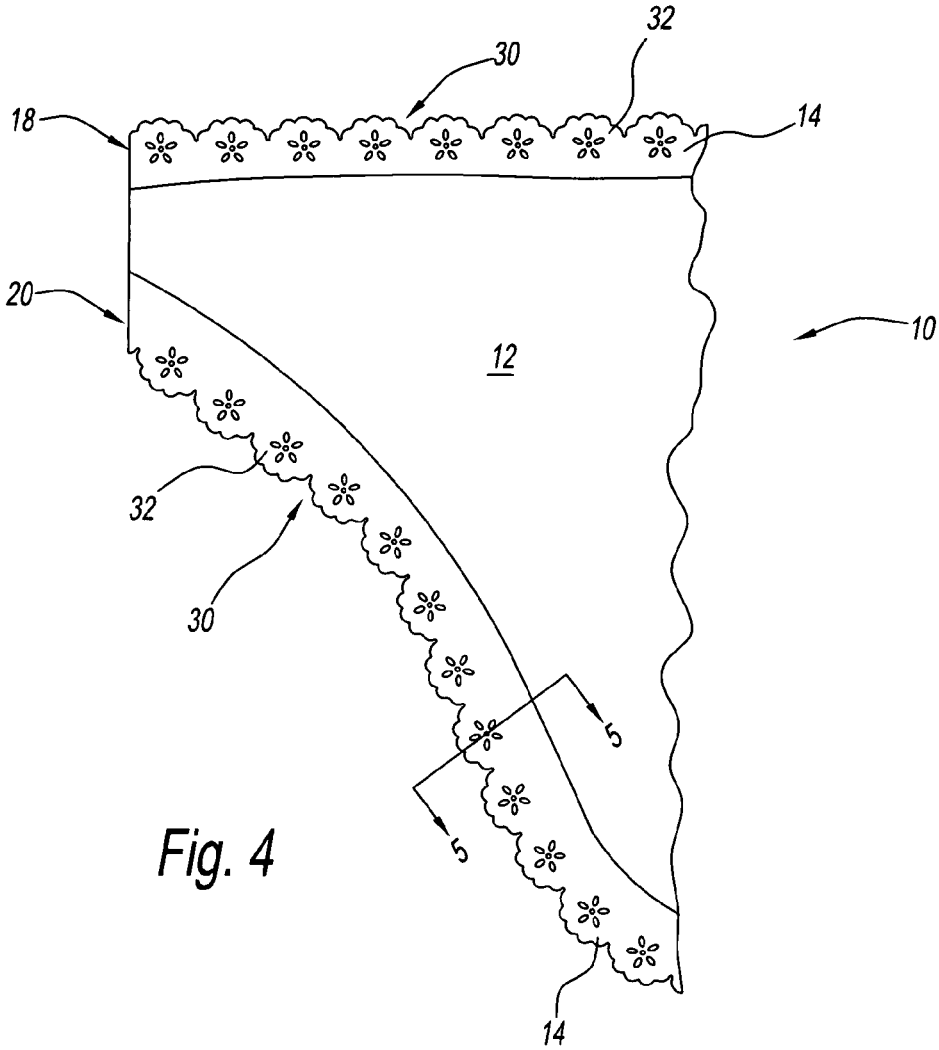
FIG. 4 is a view of a portion of an alternate exemplary embodiment of the garment of FIG. 1.
Figure 5:
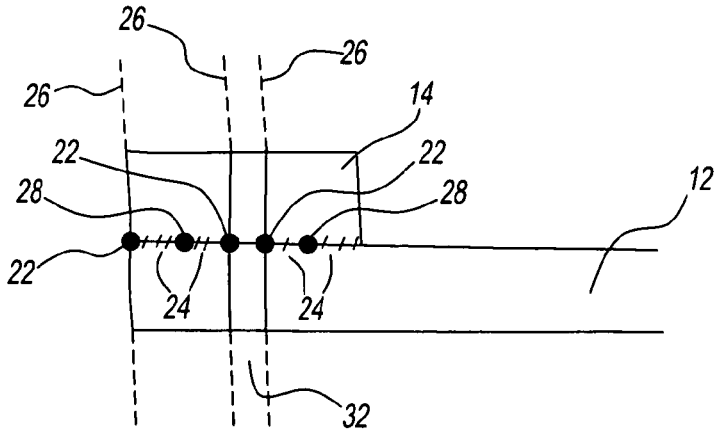
FIG. 5 is a sectional view taken along lines 5-5 of FIG. 4.

Referring now to FIGS. 4 and 5, an alternate exemplary embodiment of garment 10 is shown. Here, fabric layer 12 and edge band 14 are shown having various decorative features incorporated therein. For example, cut edge 26 is provided with a decorative pattern 30 such as, but not limited to, a scallop edge. Again, edge weld 22 is defined at decorative pattern 30 to seal cut edge 26.

In addition, fabric layer 12 and edge band 14 can include multiple cut edges 26 to provide garment 10 with a decorative effect 32, such as a lace effect. Here, an edge weld 22 is defined at each of the cut edges 26 of decorative effect 32.

In some embodiments, edge band 14 can further be seamlessly secured to fabric layer 12 by one or more tack welds 28. However, it has also been found that provision of multiple cut edges 26 and, thus, multiple edge welds 22, not only provides decorative effect 32, but also can mitigate the need for additional tack welds 28.

Figure 6:
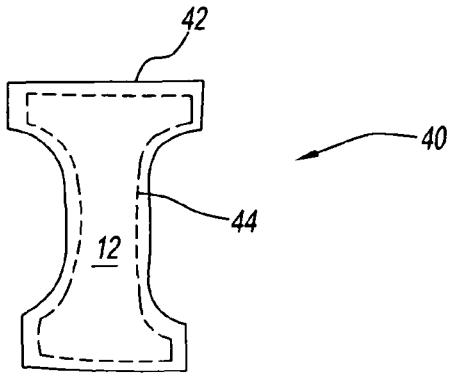
FIGS. 6 through 10 schematically depict of an exemplary embodiment of a manufacturing process according to the present invention for the garment of FIG. 1.

An exemplary embodiment of a process 40 for making garment 10 is described with reference to FIGS. 6 though 10. During a first step of process 40 shown in FIG. 6, fabric layer 12 is trimmed to the approximate shape of the finished garment. For example, fabric layer 12 can be trimmed to define a selvage 42 outside a final garment shape 44 (illustrated in phantom).

Figure 7:
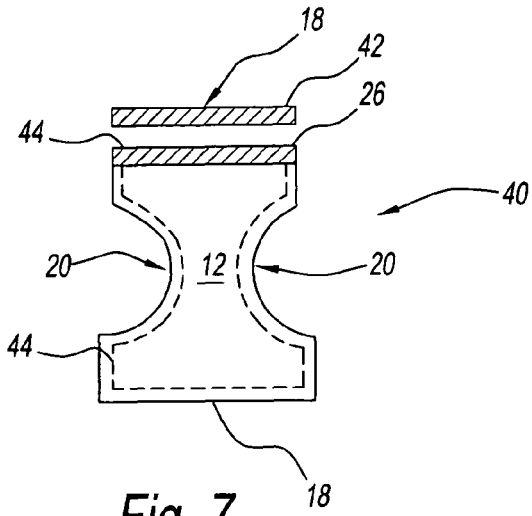

During a second step of process 40 shown in FIG. 7, edge band 14 is secured to fabric layer 12 along a portion of waist region 18. During the second process step, adhesive 24 and edge band 14 are placed on fabric layer 12 to cover a portion of selvage 42 and a portion of final garment shape 44.

In a preferred embodiment, adhesive 24 is laminated on edge band 14 prior to placement of the edge band on fabric layer 12. Here, edge band 14 is placed on fabric layer 12 so that adhesive 24 is in contact with the fabric layer.

As edge band 14 and adhesive 24 are placed on fabric layer 12, the edge band, adhesive, and fabric layer are sonically cut and welded along final shape 44 to define edge weld 22 (not shown) and cut edge 26. Selvage 42 having both fabric layer 12 and edge band 14 is removed and discarded. In some embodiments, fabric layer 12 and edge band 14 are also sonically welded to define tack welds 28 (not shown). Accordingly, the second process step applies sonic energy with sufficient intensity to simultaneously cut fabric layer 12, adhesive 24, and edge band 14 along cut edge 26 and weld the fabric layer and edge band to one another at edge weld 22 and, if present, at tack welds 28. For example, it is contemplated for process 40 to expose fabric layer 12 and edge band 14 to sonic energy of between about 20 to about 60 kilo-hertz (kHz) and a pressure of about 20 to about 40 pounds per square inch (psi).

In a preferred embodiment, the second process step of process 40 is carried out using a sealing and bonding machine commercially available under the tradenames SEAMMASTER or LACEMASTER from Sonobond Ultrasonics of West Chester, Pa.

At this point, fabric layer 12 and edge band 14 are held in place with respect to one another by edge weld 22 and, if present, by tack welds 28. It is believed that the sonic energy that creates cut edge 26 and welds 22, 28 also locally activates adhesive 24. Thus, welds 22, 28 include components of fabric layer 12, edge band 14, and adhesive 24 in addition to a localized area of activated adhesive surrounding around the welds. However, adhesive 24 remains un-activated in the remaining portions of overlap between fabric layer 12 and edge band 14.

Figure 8:
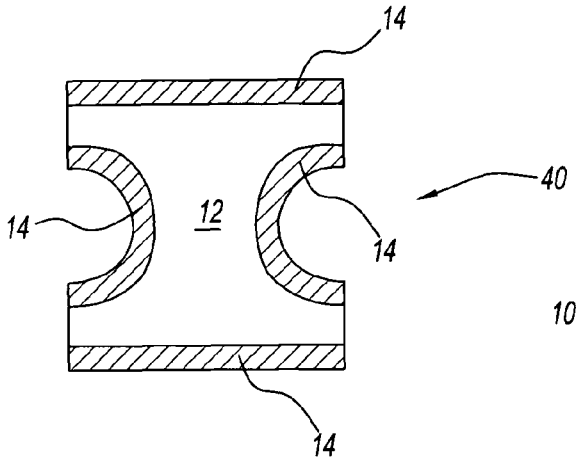

During a third step of process 40 shown in FIG. 8, the second process step is repeated to secure edge band 14 to waist and leg regions 18, 20, as desired. Again, fabric layer 12 and edge band 14 are held in place with respect to one another by the sonic welds, but adhesive 24 remains largely un-activated.

Process 40 can be easily modified to provide tack welds 28, decorative pattern 30, and/or decorative effect 32 as desired. For example, the horn used to apply sonic energy during the second and third steps can be modified using known methods to provide the tack welds 28, decorative pattern 30 and/or decorative effect 32, as desired.

Figure 9:
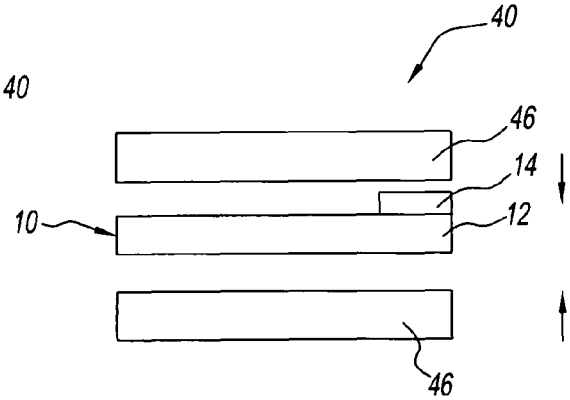

During a fourth step of process 40 shown in FIG. 9, adhesive 24 is activated. For example, fabric layer 12 and edge band 14 can be compressed between a pair of presses 46 at a pressure, temperature, and/or time sufficient to activate adhesive 24. At the end of the fourth step, fabric layer 12 and edge band 14 are secured to one another by edge weld 22, adhesive 24, and tack welds 28, if any.

Figure 10:
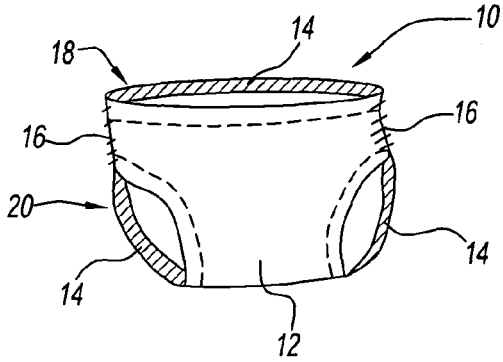

Finally, garment 10 can be completed by folding the garment and adding side seams 16 for securing portions of fabric layer 12 to one another in a fifth step of process 40 shown in FIG. 10.

Advantageously, process 40 uses sonic welds 22, 28 to hold fabric layer 12 and edge band 14 in place with respect to one another while cutting through both the band and fabric so that the edges are co-planar with one another. Process 40 then activates adhesive 24 to firmly secure edge band 14 to fabric layer 12 without deleteriously effecting the elastic characteristics of the band or the hand feel of the band and fabric. It has been determined that the combination of edge weld 22 and adhesive 24, as well as tack welds 28 if present, provide garment 10 with a desired durability, washability, hand feel, and manufacturability not previously possible.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A garment comprising:

a knitted or woven fabric layer having an inner surface;

at least one of an arm opening, neck opening, waist opening, and leg opening, the at least one opening having a periphery and an outer free edge;

an elastic edge band extending around the entire periphery only of the at least one opening, the edge band having first and second free edges and an inner surface;

the entire inner surface of the edge band overlying and in contact with only the inner surface of the fabric, the first free edge of the edge band terminating at the outer free edge of the fabric layer;

the edge band and the fabric layer each including a sonically weldable material;

a subsonic or ultrasonic edge weld securing the first free edge of the edge band to the outer edge of the at least one opening to form a finished seamless edge along the at least one opening; and an adhesive securing the edge band to the fabric layer, the adhesive along more than half of the inner surface of the edge band and securing the second free edge to the inner surface of the fabric.

2. The garment of claim 1, further comprising a plurality of subsonic or ultrasonic tack welds securing said edge band to said fabric layer.

3. The garment of claim 1, wherein at least one of said adhesive and said edge band provide elasticity to the garment.

4. The garment of claim 1, wherein said seamless edge comprises a decorative pattern.

5. The garment of claim 1, further comprising a plurality of seamless edges providing a decorative effect to the garment.

6. The garment of claim 1, wherein said fabric layer and said edge band each comprise between about ten percent and about one hundred percent of said subsonically or ultrasonically weldable material.

7. The garment of claim 1, wherein at least one of said fabric layer and said edge band comprise up to about ninety percent natural fibers.

8. The garment of claim 1, wherein the garment is selected from the group consisting of a panty, a brassiere, a shirt, a pair of pants, a coat, a sock, a pair of pantyhose, a bathing suit, a camisole, a boxer short, and a men's brief.

* * * * *

UNITED STATES PATENT AND TRADEMARK OFFICE

CERTIFICATE OF CORRECTION

PATENT NO. : 7,854,022 B2
APPLICATION NO. : 11/032285
DATED : December 21, 2010
INVENTOR(S) : Roger D. Warren et al.

It is certified that error appears in the above-identified patent and that said Letters Patent is hereby corrected as shown below:

On the patent Title page, section (56), under FOREIGN PATENT DOCUMENTS, add:

| | | |
|---|---|---|
| EP | 1 226 767 | 7/2002 |
| JP | 8-60410 | 3/1996 |
| JP | 10-298804 | 11/1998 |
| JP | 11-172505 | 6/1999 |
| JP | 2002-88523 | 3/2002 |

Signed and Sealed this
Twenty-seventh Day of December, 2011

David J. Kappos

David J. Kappos
*Director of the United States Patent and Trademark Office*